United States Patent [19]

Demetrius et al.

[11] Patent Number: 4,805,349

[45] Date of Patent: Feb. 21, 1989

[54] SANDER PAINT SCRAPER

[76] Inventors: Kris Demetrius, 2843 State St., Apt. 4, Santa Barbara, Calif. 93105; George Spector, 233 Broadway RM 3815, New York, N.Y. 10007

[21] Appl. No.: 114,514

[22] Filed: Oct. 30, 1987

[51] Int. Cl.[4] ..... B24B 23/00

[52] U.S. Cl. ..... 51/170 PT; 15/49 C

[58] Field of Search ..... 51/170 R, 170 PT, 358, 51/176; 15/49 C, 49 R

[56] References Cited

U.S. PATENT DOCUMENTS

| | | | |
|---|---|---|---|
| 1,011,490 | 12/1911 | Rasmussen | 51/170 PT |
| 1,087,068 | 2/1914 | Lueck | 51/170 R |
| 1,749,860 | 3/1930 | Vande Sandt | 51/170 PT |
| 2,120,252 | 6/1938 | Kadri | 51/170 PT |
| 2,158,940 | 5/1939 | Kadri | 51/170 PT |

FOREIGN PATENT DOCUMENTS

| | | | |
|---|---|---|---|
| 46705 | 7/1929 | Norway | 51/170 R |
| 1518431 | 7/1978 | United Kingdom | 7/197.8 |

*Primary Examiner*—Roscoe V. Parker

[57] ABSTRACT

A paint scraper and sander machine is provided and consists of a frame structure that is adjustably supported on a working surface, a contoured drum wheel rotatably supported on the frame structure for scraping and sanding the working surface and a motor supported in the frame structure for driving the drum wheel.

5 Claims, 1 Drawing Sheet

SANDER PAINT SCRAPER

BACKGROUND OF THE INVENTION

The instant invention relates generally to surface leveling devices and more specifically it relates to a paint scraper and sander machine.

Numerous surface leveling devices have been provided in prior art that are adapted to smooth the surfaces of floors or the like. For example, U.S. Pat. Nos. 919,037 and 4,099,328 all are illustrative of such prior art. While these units may be suitable for the particular purpose to which they address, they would not be as suitable for the purposes of the present invention as heretofore described.

SUMMARY OF THE INVENTION

A primary object of the present invention is to provide a paint scraper and sander machine that will overcome the shortcomings of the prior art devices.

Another object is to provide a paint scraper and sander machine that is adjustably designed to control the depth of sanding and scraping.

An additional object is to provide a paint scraper and sander machine that can travel over concave and convex areas, such as around pipes or uneven areas.

A further object is to provide a paint scraper and sander machine that is simple and easy to use.

A still further object is to provide a paint scraper and sander machine that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
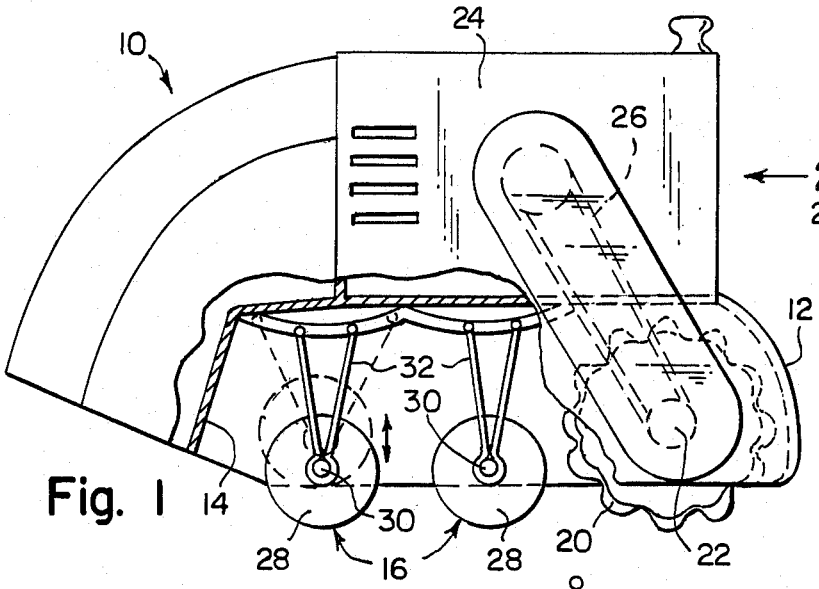
FIG. 1 is a side view of the invention with parts broken away.
Figure 2:
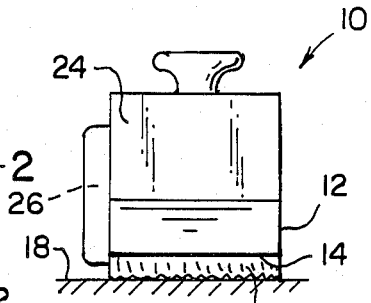
FIG. 2 is a front view taken in direction of arrow 2 in FIG. 1.
Figure 3:
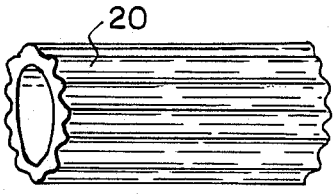
FIG. 3 is a perspective view of the contoured drum wheel.

Turning now descriptively to the drawings, in which similar reference characters denote similar elements throughout the several views, FIGS. 1 and 2 illustrate a paint scraper and sander machine 10 that consists of a frame structure 12 that has an open bottomed chamber 14. A mechanism 16 is provided for adjustably supporting the frame structure 12 on a working surface 18. The support mechanism 16 is adjustable to vary the height of the frame structure 12 to the working surface 18. A contoured drum wheel 20, as best seen in FIG. 3, is for scraping and sanding the working surface 18 and is rotatable within the open bottomed chamber 14 so as to engage the working surface 18. An axle assembly 12 is provided for supporting the drum wheel 20 on the frame structure 12 for rotation about a horizontal axis relative to the working surface 18. A motor 24 is supported on the frame structure 12 an connected in a drive relation 26 with the drum wheel 20 whereby material scraped and sanded by the drum wheel is discharged out from the open bottomed chamber 14.

The support mechanism 16 in FIG. 1 includes two pressure sensitive rollers 28, each having a shaft 30 therethrough and being horizontally rotatable and movable within the open bottomed chamber 14. Two sets of two tension springs 32 are also provided. Each set is disposed within the open bottomed chamber 14 to bias each shaft 30 of each of the rollers 28 downward so that the rollers 28 can bear against the working surface 18.

Figure 4:
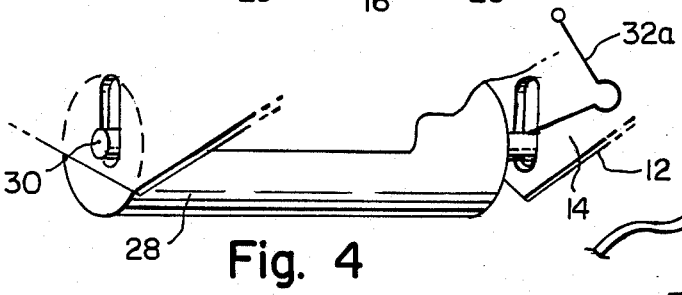
FIG. 4 is a perspective view with parts broken away showing another type of tension spring for the pressure sensitive roller.

FIG. 4 shows another type of tension spring **32*a* for the pressure sensitive roller 28 which operates in the same manor as the tension springs 32 shown in FIG. 1**.

Figure 5:
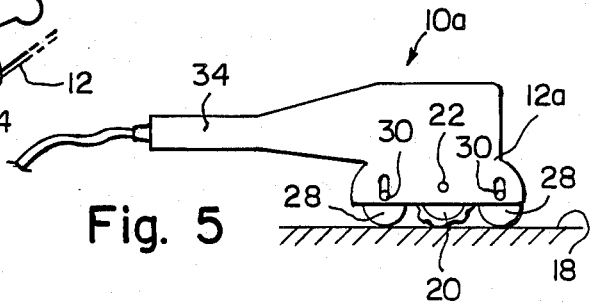
FIG. 5 is a side view of another form of the invention having an elongated handle therefrom.

FIG. 5 shows a modified paint scraper and sander machine **10*a* in which an elongated handle 34 extends from the frame structure 12*a* and the drum wheel 20 is positioned between the two rollers 28** for a better balance.

Figure 6:
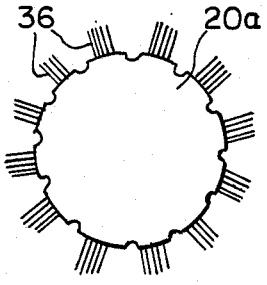
FIG. 6 is an end view of a paint removing drum wheel.

FIG. 6 shows a drum wheel **20*a* that has a plurality of thin and hard wire segments 36 thereabout for removing paint and the like. The drum wheel 20*a* can replace the other drum wheel 20** when needed.

Figure 7:
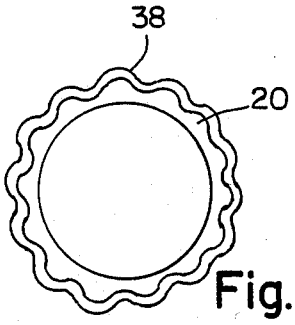
FIG. 7 is an end view of a first modified sanding drum wheel having a removable sleeve thereon.
Figure 8:
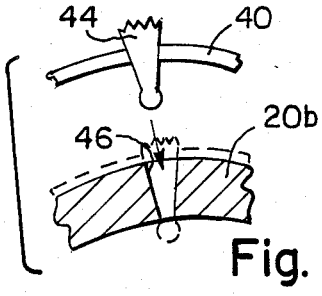
FIG. 8 is a partial exploded cross sectional view of a second modified sanding drum wheel having a removable insert sleeve with plugs thereon.
Figure 9:
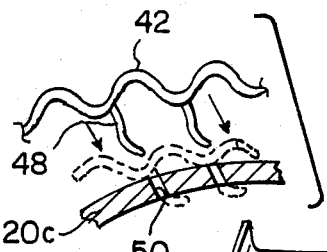
FIG. 9 is a partial exploded cross sectional view of a third modified sanding drum wheel in which the sleeve includes a plurality of hooks to engage within sockets in the sanding drum wheel.

FIGS. 7, 8 and 9 are three different removable abrasive sleeve members 38, 40 and 42 to be replaced when worn out. Sleeve member 38 just slides onto drum wheel 20. Sleeve member 40 has a plurality of abrasive plug segments 44 that fit into matching sockets 46 in drum wheel **20*b*, while sleeve member 42 has a plurality of hooks 48 extending downwardly that fit into matching slots 50 in drum wheel 20*c***.

Figure 10:
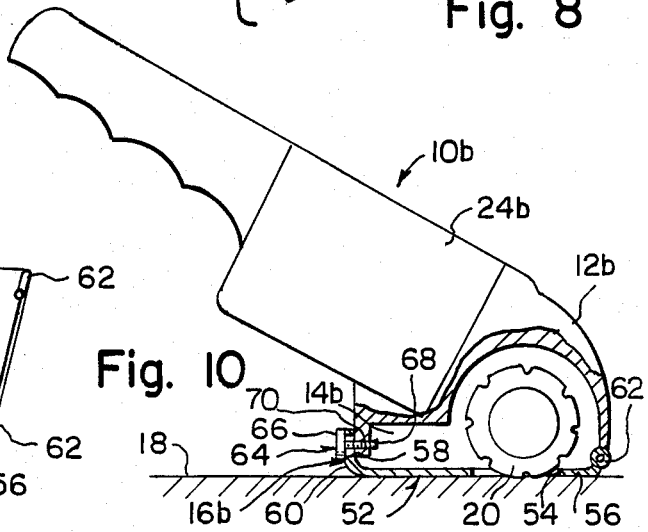
FIG. 10 is a side view with parts broken away of still another form of the invention having an adjustable lower guide plate.
Figure 11:
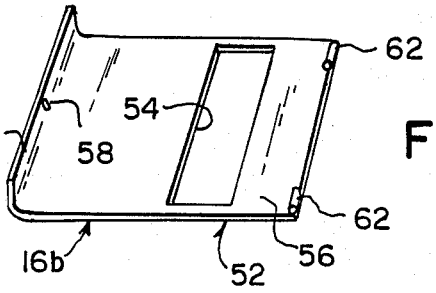
FIG. 11 is a perspective view of the adjustable lower guide plate removed therefrom.

FIG. 10 shows another modified paint scraper and sander machine **10*b* with another type of adjustable support mechanism 16*b* as best seen in FIG. 11, which includes a lower L-shaped plate 52 that has an aperture 54 in long arm 56 of the plate and a slot 58 in short arm 60 of the plate. The long arm 56 is hinged at 62 to one side of the open bottomed chamber 14*b* of the frame structure 12*b* so as to cover the open bottom chamber allowing the drum wheel 20 to extend beyond the aperture 54 in the long arm 56. A set screw 64 has a knob 66 and a threaded shaft 68 extending through the slot 58 in the short arm 60 of the plate 52** and into a threaded hole 70 in the frame structure 12*b* adjacent the open bottomed chamber 14*b* in which the plate 52 can be angularly adjusted to the horizontal with respect to the work surface 18 by tightening and loosening the knob 66 of the set screw 64.

The invention contains approximately one fortieth the frictional area of a conventional belt sander, while the drum wheel has additionally a built up momentum of its contoured wave intervals.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A paint scraper and sander machine which comprises:

(a) a frame structure having an open bottomed chamber;

(b) means for adjustably supporting said frame structure on a working surface, said support means being adjustable to vary the height of the frame structure to the working surface;

(c) a scraping and sanding wheel rotatable within the open bottomed chamber so as to engage the working surface;

(d) means for supporting said scraping and sanding means on said frame structure for rotation about a horizontal axis relative to the working surface; and (e) a motor supported on said frame structure and connected in a drive relation with said scraping and sanding wheel, whereby material scraped and sanded by said wheel is discharged out from the open bottomed chamber, wherein said adjustable support means includes:

(a) two pressure sensitive rollers each having a shaft therethrough and being horizontally rotatable and moveable within the open bottomed chamber; and (b) two sets of two tension springs, each set disposed within the open bottomed chamber to bias each shaft of each said rollers downward so that said rollers can bear against the working surface, wherein said frame structure includes slots for providing vertical movement of said shafts for adjustment purposes, said springs being external to said slots.

2. A paint scraper and sander machine as recited in claim 1, wherein said slots are located adjacent said shafts to enable said shafts to adjust vertically.

3. A paint scrapers as in claim 1, wherein said slots are spaced from and above said shafts, said spring sets each being v-shaped with arms in said slots.

4. A paint scraper and sander machine as recited in claim 1, wherein said sanding wheel further includes a removeable abrasive sleeve member to be replaced when worn out, said sleeves having transverse prongs which snap fit into respective holes in said wheel, sand prongs having outer abrasive ends.

5. A paint scraper and sander machine wheel in combination with a support frame comprising:

(a) a lower L-shaped plate having an aperture in a long arm of said plate and a slot in a short arm of said plate, the long arm hinged to one side of an open bottomed chamber of said frame structure so as to cover the open bottomed chamber allowing said scraping and sanding wheel to extend beyond the aperture in the long arm; and (b) a set screw having a knob and a threaded shaft extending through the slot in the short arm of said plate and into a threaded hole in said support frame adjacent the open bottomed chamber whereby said plate can be angularly adjusted to the horizontal with respect to the work surface by tightening and loosening the knob of said set screw.

* * * * *